United States Patent [19]

Suarez et al.

[11] Patent Number: 4,961,563

[45] Date of Patent: Oct. 9, 1990

[54] TUNDISH FOR INGOT POURING

[75] Inventors: Francis S. Suarez, Huntington, W. Va.; James E. Roberts, Proctorville, Ohio; Vinayak P. Kamdar; James R. Hyatt, both of Huntington, W. Va.; Lloyd A. Lowe, Catlettsburg, Ky.

[73] Assignee: INCO Alloys International, Inc., Huntington, W. Va.

[21] Appl. No.: 364,149

[22] Filed: Jun. 12, 1989

[51] Int. Cl.[5] ..... C21B 3/00

[52] U.S. Cl. ..... 266/229; 266/275; 222/591

[58] Field of Search ..... 266/45, 275, 236, 229; 222/591; 164/437, 335, 337

[56] References Cited

U.S. PATENT DOCUMENTS 3,343,591 9/1967 Lorang ..... 164/155
4,125,146 11/1978 Müller et al. ..... 164/437
4,770,395 9/1988 Vo Thanh et al. ..... 266/275

FOREIGN PATENT DOCUMENTS 0086662 6/1980 Japan ..... 164/437

*Primary Examiner*—S. Kastler
*Attorney, Agent, or Firm*—Francis J. Mulligan, Jr.; Edward A. Steen

[57] ABSTRACT

A tundish system for teeming an entire heat from a furnace into a mold. The tundish includes a plurality of chambers; one chamber including a nozzle. The chambers are arranged to interrupt the flow of the heat from one chamber to another thereby causing better separation between the metal and the slag. The tundish is mounted on a movable frame supporting a plurality of molds. A trough is disposed between the tundish and the molds. During the pour, the tundish remains stationary as the trough and the molds are moved underneath in succession.

2 Claims, 4 Drawing Sheets

TUNDISH FOR INGOT POURING

TECHNICAL FIELD

The instant invention relates to metal pouring techniques in general, and more particularly, to a tundish system for pouring multi-ingot heats from a furnace.

BACKGROUND ART

Conventional vacuum induction melt (VIM) furnace teeming practice generally consists of one tundish per electrode mold. After the melting process has been completed in the furnace, a metered quantity of the melt is poured into a simple box tundish disposed above an electrode mold. The tundish/mold combination is situated below the furnace spout. Depending on the quantity of the melt, a number of tundish/mold combinations are sequentially moved in series to receive the melt as the preceding mold is filled up. The pouring stream would be stopped after the first electrode was filled and the next tundish/mold combination would be moved under the spout. The process would be repeated until the melt was exhausted.

Towards the end of the pour, it becomes difficult to judge how much metal to leave in the tundish for fear of overflowing the mold. This uncertainty may result in short hot tops and insufficient metal in the tundish towards the end of the pour resulting in poor metal/slag separation.

SUMMARY OF THE INVENTION

Accordingly, there is provided a multi-chambered tundish system that permits an entire VIM heat to be poured through one stationary tundish into a succession of molds mounted in a movable mold car.

PREFERRED MODE FOR CARRYING OUT THE INVENTION

FIGS. 1–4 show a multi-compartment tundish 10. The tundish 10 includes an insulated exterior sidewall 12 forming the outer periphery, i.e., the sides and bottom of the tundish 10.

Figure 1:
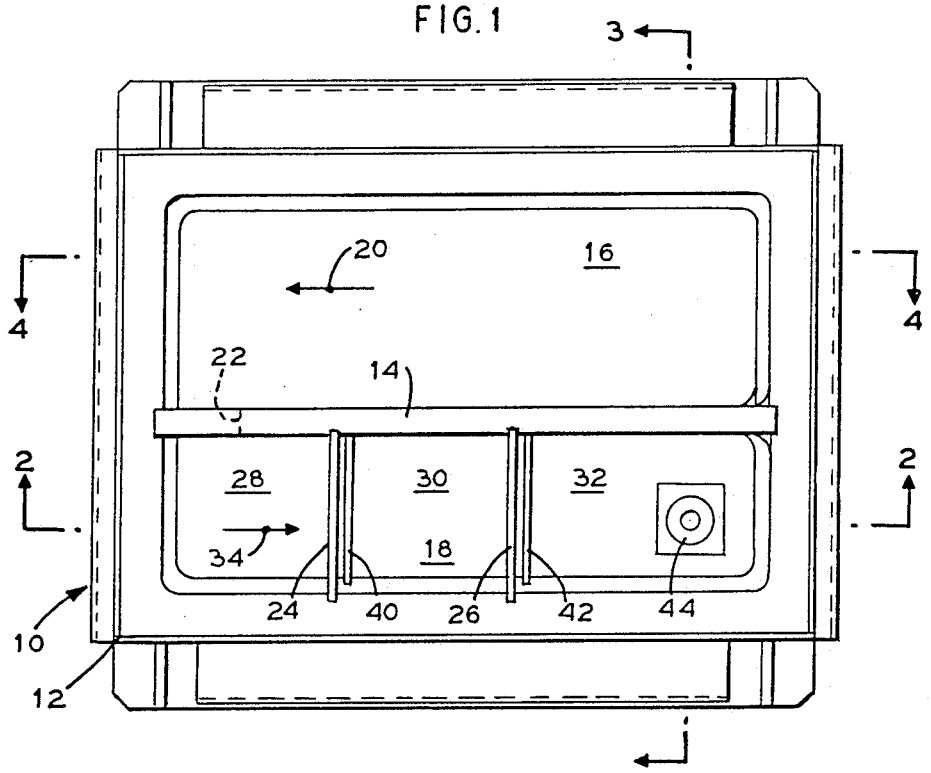
FIG. 1 is a plan view of an embodiment of the invention.
Figure 2:
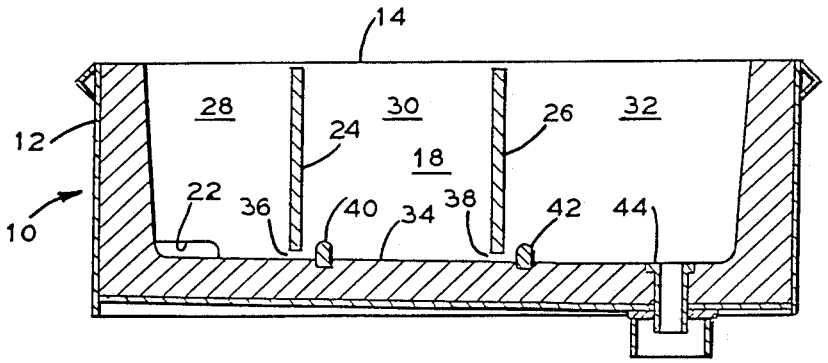
FIG. 2 is a cross-sectional view of FIG. 1 taken along line 2—2.
Figure 4:
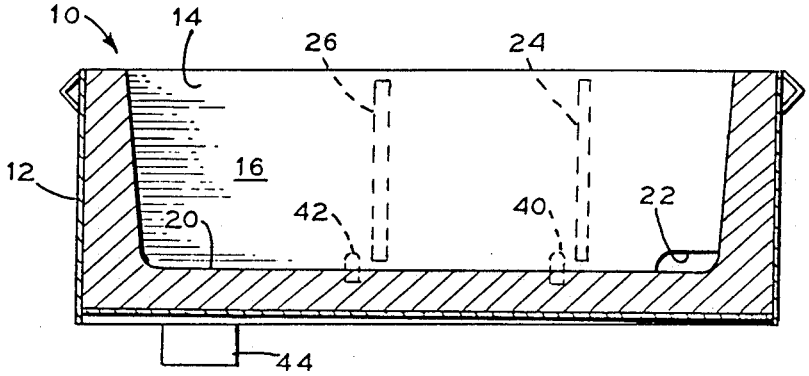
FIG. 4 is a cross-sectional view of FIG. 1 taken along line 4—4.
Figure 3:
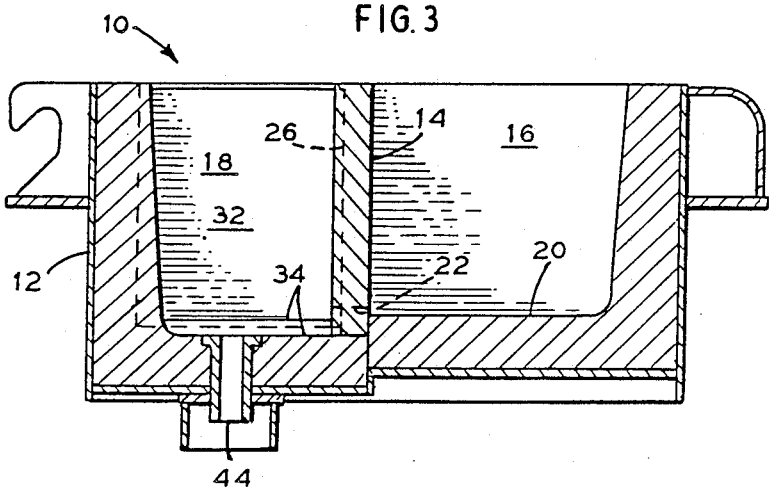
FIG. 3 is a cross-sectional view of FIG. 1 taken along line 3—3.

A divider 14, preferably constructed from a high temperature resistant refractory, splits the tundish 10 into sequential first and second longitudinal sectional compartments 16 and 18 respectively. First section 16 includes a sloped bottom 20. Simply for the sake of establishing a non-limiting convention, the bottom 20 slopes downwardly towards the left-hand side of the tundish 10 as shown in FIG. 1. Second section 18 similarly includes a sloped bottom 34. In keeping within the convention, the bottom 34 is sloped downwardly towards the right-hand side of the tundish 10 as shown in FIG. 1. The tundish 10 may also be flat bottomed although the slope aids in metal flow.

The divider includes an aperture 22 generally disposed towards the lowest elevation of the sloped bottom 20 and conversely towards the highest elevation of the sloped bottom 34.

A plurality of baffles 24 and 26 disposed in the second compartment 18, preferably constructed from a high temperature resistant refractory, extend between the divider 14 and the sidewall 12. The baffles 24 and 26 further subdivide the second compartment 18 into a plurality of sequential chambers 28, 30 and 32. Gaps 36 and 38 are formed between the sloped bottom 34 and the baffles 24 and 26 respectively. A ceramic filter can be used in place of the baffle 26.

A plurality of weirs 40 and 42, also preferably constructed from a suitable refractory, lie parallel with the baffles 24 and 26 and extend between the divider 14 and the sidewall 12. They are attached to the sloped bottom 34 and are sized to be about equal to or greater than the height of the gaps 36 and 38.

The chamber 32 includes a nozzle 44 preferably mounted towards the lowest elevation of the sloped bottom 34.

In general, the interior of the sidewall 12 should be slightly sloped to accommodate a liner (not shown) that corresponds to the internal configuration of the sidewalls 12 and the bottoms 20 and 34.

Although many suitable materials may be used to construct the tundish 10, satisfactory results were achieved with the sidewall 12 and bottoms 20 and 34 made from Brikam® castable high alumina refractory. The divider 14, baffles 24, 26 and weirs 40 and 42 were constructed from prefired bricks made from a 65% alumina and 35% alumina-silica refractory.

The invention and manner of applying it may perhaps be better understood by a brief discussion of the principles underlying the invention.

An entire heat from a furnace is poured into the first section 16. Due to the slope 20, the metal flows to the "left" towards the aperture 22 where it first enters chamber 28. Flow is now driven to the "right" due to the slope 34. The under/over flow action engendered by the parallel spaced baffle 24 and weir 40 combination provides a serpentine flow path into the adjacent chamber 30. The flow procedure is repeated as the melt travels into the chamber 32. The melt eventually exits the tundish 10 via the nozzle 44.

The single tundish 10 design provides for better separation of metal and slag. As a result, scrap cleaning costs have been substantially reduced with no detriment to metal quality.

Figure 5:
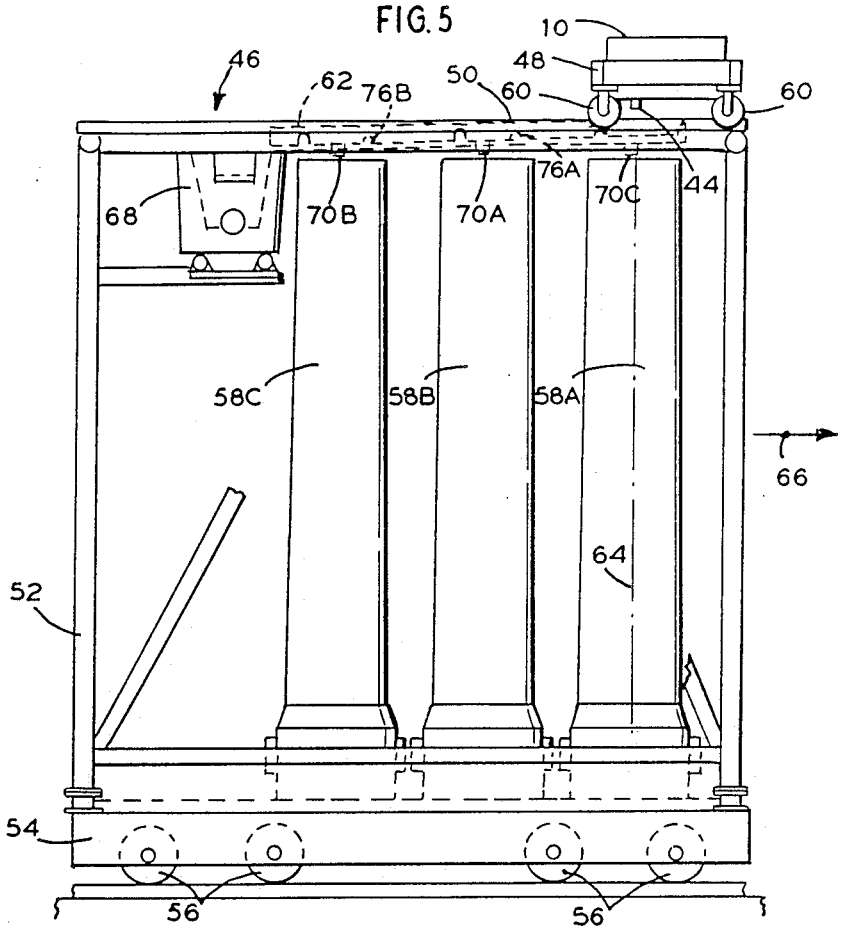
FIG. 5 is an elevation of an embodiment of the invention.
Figure 6:
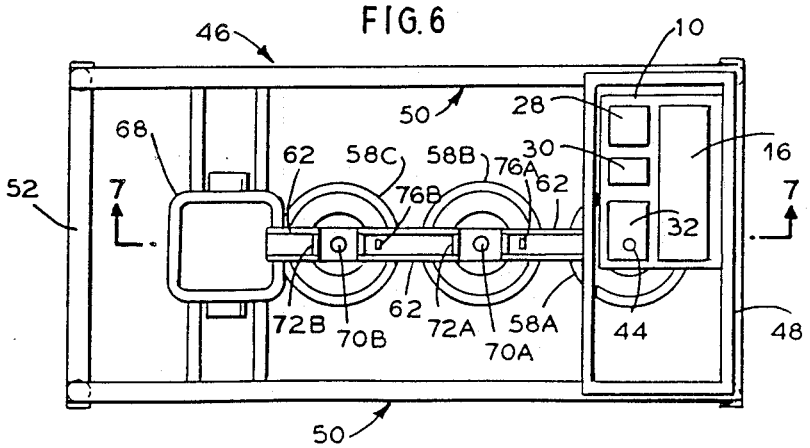
FIG. 6 is a plan view of FIG. 5.
Figure 7:
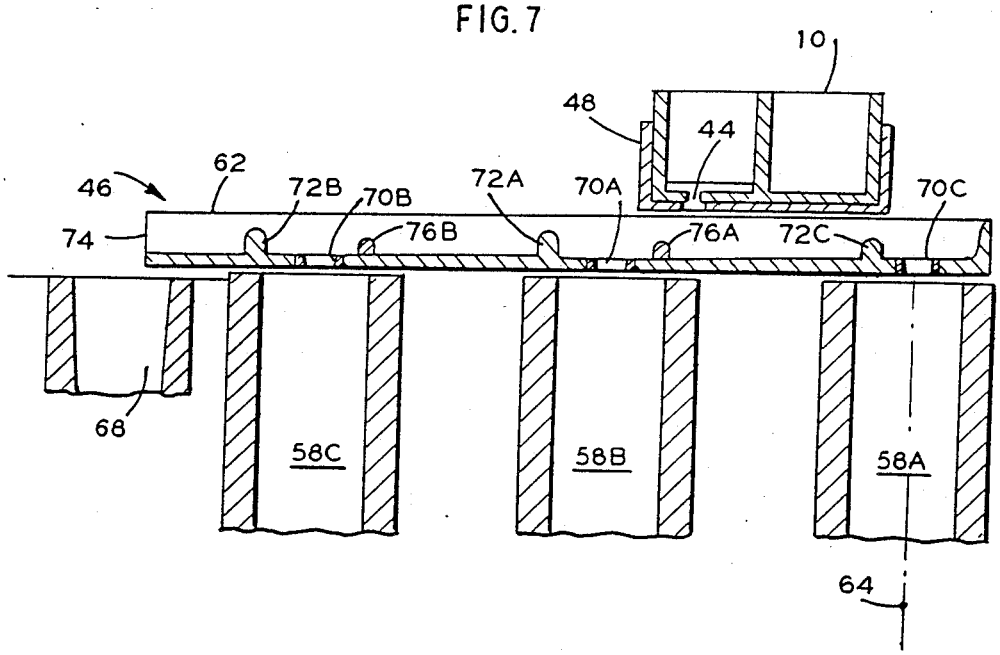
FIG. 7 is a cross-sectional view of FIG. 6 taken along line 7—7.

FIGS. 5, 6 and 7 represent a multi-ingot pouring system 46 employing the tundish 10.

A mold car pipe frame 52, including a base plate 54, is movable due to a plurality of attached rollers 56. A series of ingot molds 58A, 58B, 58C are vertically supported by the frame 52 and rest on the base plate 54.

The tundish 10 is disposed in a tundish car 48. The wheels 60 of the tundish car 48 sit on a pair of tracks 50 located at the top of the frame 52. A slightly inclined transfer trough 62 lies above the top of each mold. A butt mold 68 may be situated next to the last mold 58C in the pouring sequence.

The transfer trough 62 is shown in more detail in FIG. 7. The trough 62 is disposed over the tops of the molds 58A, 58B and 58C and the butt mold 68. Essentially acting as an inclined spillway, the trough 62 includes apertures 70A, 70B and 70C and risers 72A, 72B and 72C. The apertures 70A, 70B and 70C are configured to be centered over the center lines (only 64 is shown) of the molds 58A, 58B and 58C. The risers 72A, 72B and 72C act as barriers to chamber the trough 62 and to contain excess molten material pouring from the nozzle 44 and ensuring that it flows into the mold directly below the trough 62. Since the walls of the trough 62 are higher than the risers 72A, 72B and 72C, any excess material, by virtue of the incline, will flow into the next succeeding mold. The flow breakers 76A and 76B reduce mold washout when the heat is being teemed. The end 74 of the trough 62 is open to allow any remaining material to drop into the butt mold 68.

The pouring system 46 is preferably disposed under the pouring spout of a furnace (not shown). To initiate the teeming procedure, the melt car 48 is oriented to specifically place the tundish 10 directly under the pouring spout of the furnace. Simultaneously the nozzle 44 is preferably situated directly over the first mold 58A and coincident with the center line 64 of the mold 58A.

Pouring is commenced by teeming the entire heat from the furnace into the first section 16 of the tundish 10. The pouring stream exiting the tundish 10 continues unabated throughout the teeming of the heat into the molds. After the first mold 58A is filled, the mold car pipe frame 52 is moved (direction arrow 66) while the tundish car 48 is held stationary until the nozzle 44 is centered over the next mold 58B. Excess metal is carried from one mold to the next via the transfer trough 62. The process is continued from one mold to the next until the heat is exhausted or the excess metal is dropped into the butt mold 68.

A refractory cover may be used over the chamber 32 to prevent slag and metal from being splashed into the chamber 32.

The design of the single tundish 10 provides for better separation of metal and slag than the previous multi-tundish practice. As a result, scrap cleaning costs have been reduced with no detriment to metal quality. The instant tundish 10 permits the use of uncleaned scrap in assignee's VIM furnaces for recycling purposes. Indeed, the assignee is now using up to 30% uncleaned scrap in the heats, whereas the previous multi-tundish system only permitted the use of high cost cleaned scrap.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows.

1. A tundish for teeming heats, the tundish comprising a container having sidewalls and a bottom, the container divided into a pair of adjacent first and second longitudinal compartments by a divider, the bottoms of the first and second longitudinal compartments of the container sloped in opposing directions for facilitating heat flow, an aperture disposed within the divider, the second longitudinal compartment subdivided into a plurality of sequential chambers, most of the chambers flowably disposed to receive the heat from an adjacent chamber, heat flow disturbing means disposed between at least some of the chambers, and one chamber including a nozzle.

2. The tundish according to claim 1 disposed above a mold, the mold disposed in a frame, the tundish engaging the frame, and means for moving the frame and the mold relative to the tundish.

* * * * *